United States Patent [19]

Hutson

[11] Patent Number: 4,657,056

[45] Date of Patent: Apr. 14, 1987

[54] LOG DEBARKING TOOL ASSEMBLY

[76] Inventor: James H. Hutson, Rte. 4, Box 925, Pell City, Ala. 35125

[21] Appl. No.: 799,653

[22] Filed: Nov. 19, 1985

Related U.S. Application Data

[60] Continuation-in-part of Ser. No. 696,527, Jan. 30, 1985, abandoned, which is a division of Ser. No. 527,814, Aug. 30, 1983, Pat. No. 4,585,042, which is a continuation-in-part of Ser. No. 430,794, Sep. 30, 1983, Pat. No. 4,522,242.

[51] Int. Cl.[4] ..... B27L 1/00

[52] U.S. Cl. ..... 144/208 E; 144/340

[58] Field of Search ..... 144/208 R, 208 E, 241, 144/340

[56] References Cited

U.S. PATENT DOCUMENTS

| | | | |
|---|---|---|---|
| 2,787,304 | 4/1957 | Brundell et al. . | |
| 2,788,034 | 4/1957 | Brundell et al. . | |
| 2,880,771 | 4/1959 | Annis, Jr. . | |
| 2,903,028 | 9/1959 | Brundell et al. . | |
| 3,115,167 | 12/1963 | Valo | 144/208 E |
| 3,221,785 | 12/1965 | Valo . | |
| 3,709,272 | 1/1973 | Bowers . | |
| 3,863,692 | 2/1975 | Hasada . | |
| 3,973,607 | 8/1976 | Jonsson . | |
| 4,280,541 | 7/1981 | Reimler et al. | 144/208 E |
| 4,425,951 | 1/1984 | Pousette et al. | 144/208 E |
| 4,438,794 | 3/1984 | Carpenter et al. . | |

FOREIGN PATENT DOCUMENTS

| | | | |
|---|---|---|---|
| 406336 | 4/1974 | U.S.S.R. . | |
| 560749 | 9/1977 | U.S.S.R. | 144/208 E |

*Primary Examiner*—W. D. Bray

*Attorney, Agent, or Firm*—Lalos, Keegan & Kaye

[57] ABSTRACT

A cutting tool assembly for a log debarker. A cutting tool is provided having an elongated leading cutting edge and a key member. The key member fits into the load carrying slot portion of the head of the tool shaft, and the tool is then secured to the tool shaft head with a plurality of retainer bolts. The tool shaft head is machined at an angle of generally five degrees relative to the axis of an incoming log so as to slant the orientation of the tool and its leading edge. Thus, an incoming log will impact initially a central location of the tool and not its full length. A tensioning device places the tool shaft in tension about a pivot axis and the outermost tip of the tool continually points towards the center line of an incoming log as the tool shaft pivots about this pivot axis. Every other tool is extended a slight distance further towards the incoming log than the adjacent tools by an extension spacer or washer to further reduce the shock loading previously encountered.

35 Claims, 6 Drawing Figures

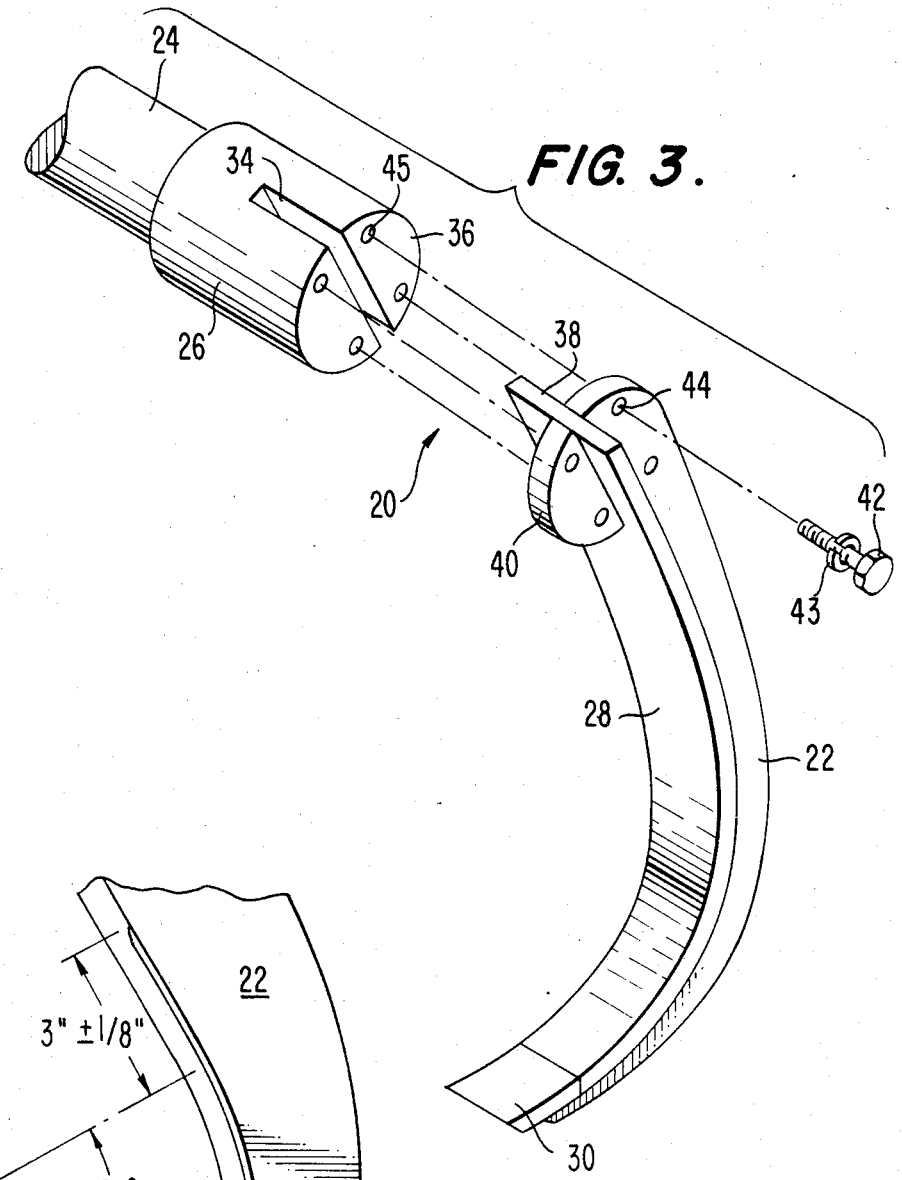
FIG. 3.
FIG. 4.
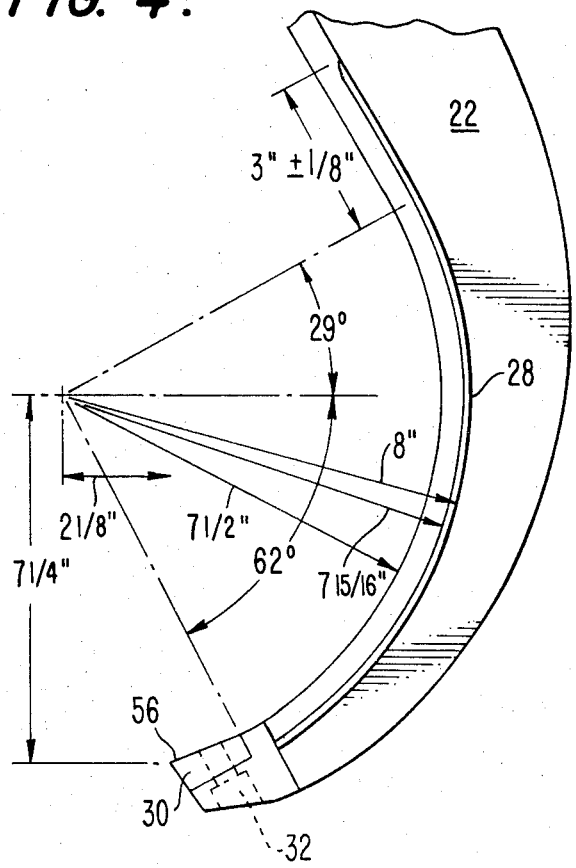

LOG DEBARKING TOOL ASSEMBLY

CROSS REFERENCE TO RELATED APPLICATIONS

This is a continuation-in-part of application Ser. No. 696,527, filed Jan. 30, 1985, now abandoned, which is a divisional of application Ser. No. 527,814, now U.S. Pat. No. 4,585,042, filed Aug. 30, 1983, which is a continuation-in-part of application Ser. No. 430,794, filed Sept. 30, 1983, now U.S. Pat. No. 4,522,242. The contents of application Ser. No. 696,527 are hereby incorporated by reference in their entirety.

BACKGROUND OF THE INVENTION

The present invention relates to log debarking machines and more particularly to hollow head log debarkers having a ring rotor through which successive logs are fed. The logs in such debarkers are engaged and stripped of their bark by arcuate debarking tools rotatably supported by the ring rotor. The present invention is further concerned with debarking tool assemblies for such debarking machines.

Generally, the prior art teaches that several debarking tools are mounted around the central opening of the rotor and in their inoperative positions they extend about radially inwards with the debarking tips located close to the axis of the rotor. When the rotor rotates and a log is fed into the rotor inlet or infeed side, the front end of the log strikes the sharp leading edge of the debarking tools and causes them to climb onto the debarking surface of the log against the action of resilient or tensioning means. The leading edges of the tools are thereby caused to climb up on the log surface.

The debarking tools are positioned perpendicular to the flow so that when the log strikes the tools' leading edge the tools have to climb the face of that log to where the tool tip is riding on the debarking surface before the log can travel further. This causes a tremendous shock load to all parts of the debarker. Further, the larger the log diameter the greater the movement of the tool tip to the debarking surface and correspondingly the greater the shock load.

The geometric design of the prior art debarking tools is around the climbing edge so that the larger the log diameter the flatter the tool tip lay back on the log. Since the sharp tool tip is not pointed towards the theoretical centerline of the debarker, the pressure required to debark the logs is great. This causes shock loading, tool breakage, tension pin breakage, tension band breakage, and unnecessary shock to the entire debarker. Further, tools in the past have used a clamp method to retain the debarking tool in or on the tool shaft. This clamping has resulted in excessive shock loading to the tools and loosening of the tool arm in the tool shaft, which causes metal fatigue in the tool mounting area.

The present method of harvesting trees uses a shearing rather than a sawing action to cut the trees down. The shearing causes fractured fiber at the log for logs of all diameters, especially the larger logs. The fractured fiber then does not give sufficient stability for the sharp leading edge of the debarking tool to bite into, with the forces spread out through the entire debarking tool. Thus, the tools cannot efficiently climb the log to mount onto its debarking surface. The operator often will then have to reduce the pressure on the debarking tool, in which case the debarking tool will not remove the bark. Alternatively, the operator can stop each effected log and saw the sheared fiber from the log end, but in addition to slowing the debarking operation fiber is lost. The third alternative is for the operator to stop each effected log and saw it at an angle so that the end of the log can slope behind the debarking tool and mount the log by climbing the angled end of the log to the debarking surface, but, as can be appreciated, this also is an inefficient procedure.

OBJECTS OF THE INVENTION

Accordingly, it is the principal object of the present invention to provide an improved hollow head log debarker.

Another object of the present invention is to provide an improved log debarking tool assembly.

A further object of the present invention is to provide an improved log debarking tool assembly design which results in less shock loading throughout the debarker.

A still further object of the present invention is to provide an improved tool assembly design which does not require that the log slow momentarily on contact, and thus provides for a faster debarking cycle.

Another object is to provide an improved log debarking tool assembly which is capable of mounting large logs and which also allows small logs to enter the debarking machine without having to climb the log's leading edge.

A further object is to provide a tool assembly which allows the tool to climb or mount the end of the log to the debarking surface more easily than was previously possible.

A still further object is to provide a tool assembly design which allows the tool to more easily and readily mount fractured fiber on the end of the log, and also to mount logs previously rejected thereby conserving our natural resources.

Another object is to provide an improved tool assembly design which has less tendency to dull the sharp leading edge of the tool and thus makes the bark tool change out less frequent.

A further object is to provide a tool assembly requiring less force to cause the tool to climb onto the debarking surface and once mounted to remove the bark.

A still further object is to provide a tool assembly design which allows the sharp debarking tip to ride on the log surface throughout its log debarking range more efficiently.

Another object is to provide an improved log debarking tool assembly which reduces tool breakage.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIG. 3 is a perspective exploded view of the tool assembly of FIG. 1.

FIG. 4 is an enlarged fragmentary elevational view of the tool tip of the assembly of FIG. 1 indicating the curvature thereof.

DETAILED DESCRIPTION OF THE INVENTION

Figure 1:
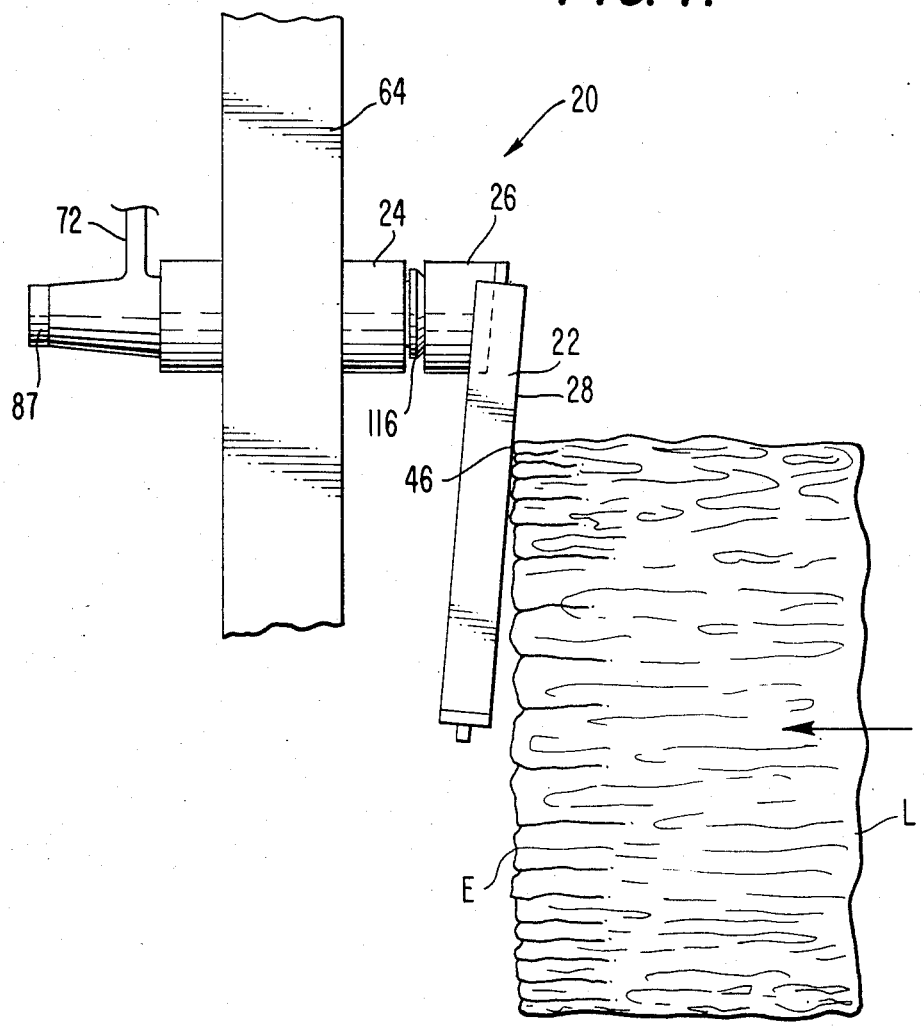
FIG. 1 is a fragmentary side elevational view of a tool assembly of the present invention.

Referring to FIG. 1 a log debarker tool assembly of the present invention is illustrated generally at 20. For clarity's sake, the other components of the log debarker including the other tool assemblies and feed rolls are not shown. Generally though there will be two–eight additional tool assemblies, three infeed feed rolls, and three outfeed feed rolls, such as is shown in U.S. Pat. No. 4,522,242. An incoming log L is shown initially impacting the tool 22 of tool assembly 20. As illustrated, the log has a fractured end E as is commonly encountered in today's debarking situations.

Figure 2:
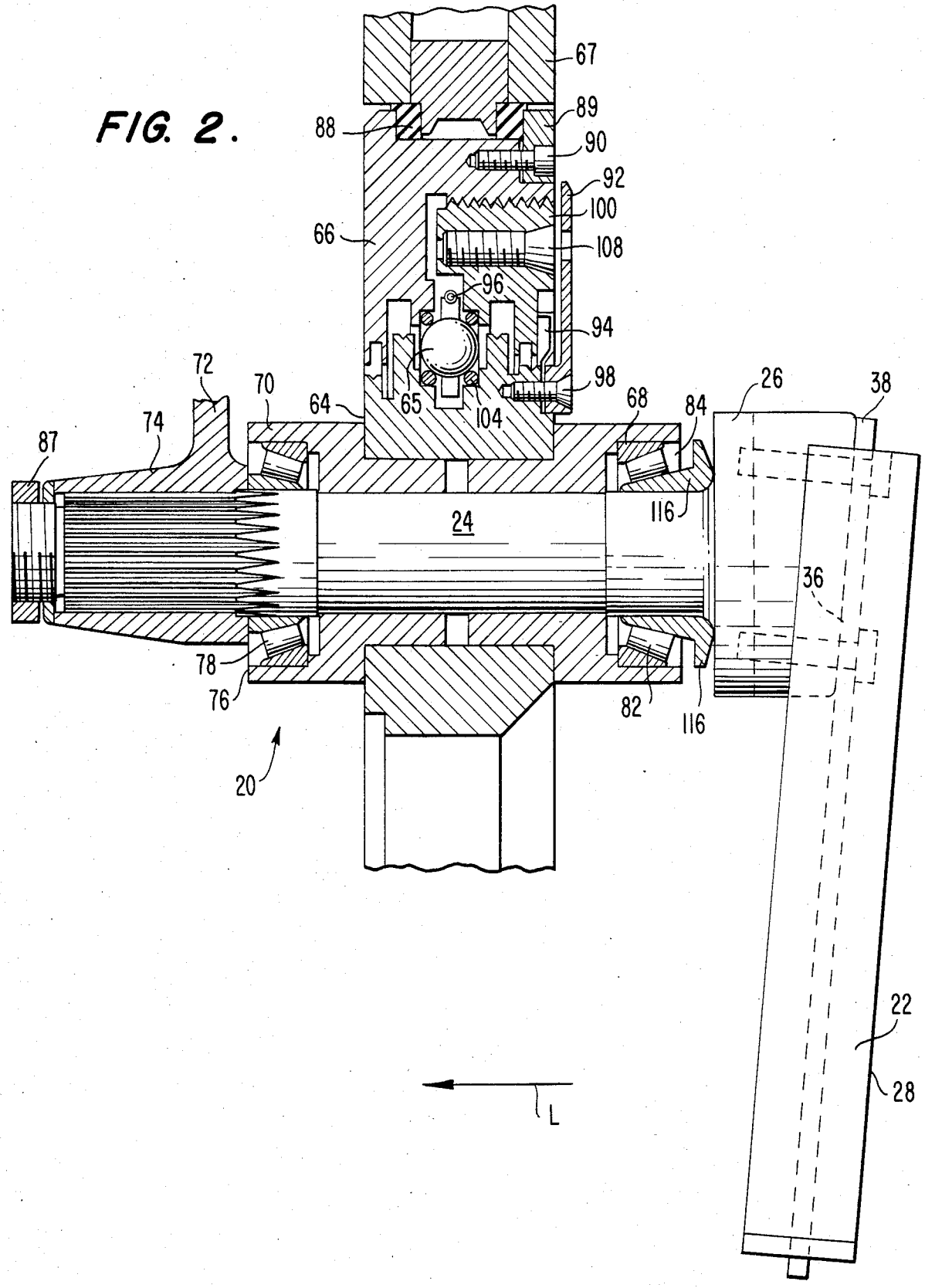
FIG. 2 is an enlarged cross sectional view of the tool assembly of FIG. 1.

Tool assembly 20 is shown to basically comprise a tool shaft 24, a tool shaft head 26 secured to, or a part of, the end of tool shaft 24 and log debarking tool 22. Tool 22 is generally rigid and formed of 4130 steel alloy and has a sharp cutting edge 28. Tool 22 has a replaceable tip 30 as best shown in FIGS. 3 and 4, which is secured in place by a replaceable tool tip bolt 32, illustrated in FIG. 4. Tool shaft head 26 has a slot portion 34 extending through the tool shaft head face 36 and debarking tool 22 has a corresponding load-carrying retainer plate or key member 38 which is configured to slide into slot 34 so that the face 40 of the tool is securely against head face 36. Tool head face 36 has generally the same cross-section as face 40. After key 38 has been fitted in slot 34, four retaining bolts 42 with lock washers 43 are bolted through the tool openings 44 into holes 45 of tool shaft head face 36, as best shown in FIG. 3. Tool shaft head face 36 is machined at an angle relative to the axis of the shaft, as shown in FIG. 2. It is expected that this angle would be between three and eleven or fifteen degrees, inclusive. A typical preferred angle would be five degrees but then this is dependent upon among other things the size of the rotor ring opening. However, for this slant mounting to work properly, tool 22 must be rigidly mounted to tool shaft 24 and have very little or no deflection. The key and slot arrangement (38, 34) held in place by the retainer studs 42 provide this rigid mount.

As best illustrated in FIGS. 2 and 3, face 36 is angled in the direction of the incoming log. Since the face is sloped in the direction of log travel, leading edge 28 of the tool is sloped as well. Any suitable tool or tool mount design which slopes the leading edge of the tool is within the scope of the present invention. Another example would be to mount the tool to the shaft in a conventional perpendicular mount but design the tool, as by tapering its thickness, so that its leading edge recedes or slopes relative to the mount and thus to the axis of the incoming log.

Figure 5:
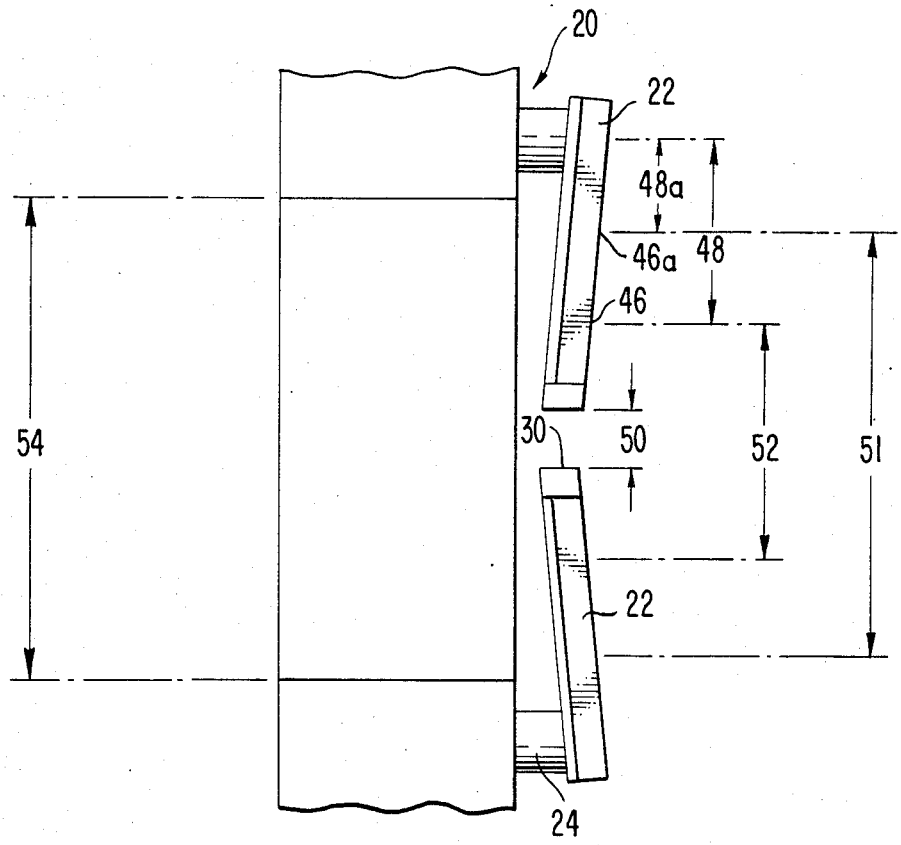
FIG. 5 is a side elevational schematic of a log debarker showing the mounting on the rotor of two tool assemblies of the present invention.

Thus, since prior art debarkers mount the tools or more particularly the tool's leading edge perpendicular to the incoming log, the log impacts the entire length of the tool and the moment arm created is generally from the tip of the tool to the tool shaft—a very long moment arm. In contrast, with the present mounting angled in the direction of the incoming log the log L impacts tool 22 initially at a central location 46 and 46*a* as illustrated in FIGS. 1 and 5. As best shown in FIG. 5, this creates a much shorter moment arm illustrated generally at 48. As further shown in FIG. 5 this tool design provides for a tool mounting which can debark logs having a minimum log diameter shown at 50 and a maximum log diameter shown at 51 and a mean diameter at 52. The maximum rotor ring opening is illustrated at 54. The rotating forces or torque required to open the tools are directly related to this moment arm and thus, since the moment arm of the present design is shorter, the opening forces required are less.

Thus, debarking tool 22 is sloped in the direction of log travel with its self-sharpening leading edge 28 having all the force concentrated at a single point, location 46. This drives the sharp leading edge 28 into the leading face or end E of incoming log L sufficiently deep to insure that tool 22 will climb even the worst fractured log. In contrast, the standard tool now in use which is faced perpendicular to the log flow and does not have this concentrated force but rather its force is distributed throughout the curvature of the tool. The tool of the present invention thus has less shock loading than the tool disposed perpendicular to the log flow.

The portion of the tool tip that causes it to easily get under the outer layers is illustrated in FIG. 4 at 56. As sharp leading edge 28 of the surface of the tool is driven into the leading edge E of log L, a groove is formed in the log end. The sloped tool's sharp leading edge slides down the self-made groove in the leading edge of the log causing the fiber to act as a sharpening device for the sharpening edge. Again in contrast, for the standard tool which is situated perpendicular to the log's leading face, the sharp leading edge is ground dull as that leading edge tries to bite its full length into the face of the incoming log. Since the sharp leading edge of the present design is kept sharp because of the travel in its climbing the log, it does not have to be rebuilt and resharpened as frequently as needed in the past. Also, since the tool tip is tilted into the log surface once it has mounted the log, it acts as a disk plow in its ability to more efficiently get under the bark to the soft cambium layer.

Figure 6:
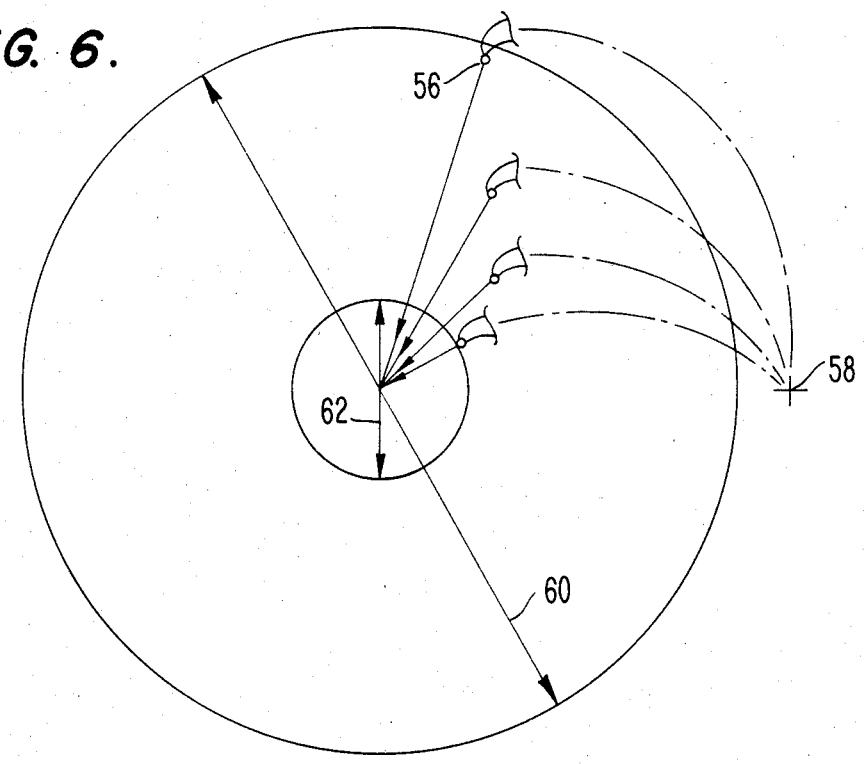
FIG. 6 is an end view of the tool assembly of FIG. 1 illustrating the different positions of the tool tip relative to the axis of the log throughout the log debarking range.

Another advantage of the sloped tool design is that through the use of computer design as set forth by example only in FIG. 4, the sharp leading debarking tool tip 56 can be directed to continually point towards the debarker's theoretical center line throughout the debarker's log debarking range. Referring to FIG. 6, the tool's pivot point is shown at 58, the maximum log diameter at 60, and the minimum log diameter at 62. With this design, less pressure is required to remove the bark from the log. This reduces tool breakage, bearing failure, tool shaft breakage and shock throughout the entire debarking machine. The design and dimensions of the curvature of the tool which help maintain this tool tip orientation are best illustrated typically in FIG. 4. Thus, the present tool design having the sharp debarking area of the tool tip slanted towards the theoretical center line of the debarker requires less force to remove the bark from the leading edge than is presently required with the tool tip laying back on its flat surface as the log diamter increases. The debarking pressure can be reduced typically with this design from 1,000 to 1,500 psi down to 600 to 700 psi. This reduces tool breakage, reduces the shock loading throughout the debarker and allows the tool to climb the end of the log to the debarking log surface easier.

It is further noted that the sloped tool causes a point of concentrated forces to drive the sharp leading edge into the fractured fiber allowing debarking tool 22 to climb onto the debarking surface. Sharp leading edge 28 can climb onto the log without the necessity of the log stopping momentarily on contact. This reduces the shock to the tools and also to the entire debarking machine.

Tool shaft 24 is secured to the infeed side of and rotatable with the rotor of the log debarker. Referring to FIG. 2, the rotor 64 is rotatable relative to the stator. Rotor 64 is rotated on bearing assembly 65 relative to ring rotor mounting 66 housed in housing 67. Tool shaft 24 is secured to the rotor in infeed and outfeed replaceable housings 68, 70 so that it can be rotated about its axis relative to the rotor. A band or other tensioning device 72 at the outfeed end 74 of tool shaft 24 keeps the tool shaft rotatably tensioned so as to keep the log debarking tool 22 firmly against the log throughout its debarking cycle. Replaceable outfeed bearing housing 70 includes a dust seal 76 and suitable tool shaft bearings 78. Tensioning device 72 is secured to the end of the tool shaft by a split self locking nut with threaded tightening screw 87. The replaceable infeed bearing housing 68 similarly contains tool shaft bearings 82 and a dust seal 84. As further explanation of FIG. 2, it is seen that the stator portion of the rotor includes a neoprene shock loading "O" ring mounting pods 88, steel mounting ring 89, mounting ring SHCS 90, dirt seal ring 92, dust seal ring 94, ball spacer 96, and FHSHCS retaining bolt 98 for dirt seal ring 92. A nut 100 is split and designed to thread into the stator portion of the rotor to allow take-up of the wear between the balls of bearing assembly 65 and ball seating wires 104 (four each—two inner and two outer). The tapered head on the jamming bolt SHCS 108 forces the male threads into the female threads locking the rotor take-up at a desired bearing tolerance but by unscrewing bolt 108 will allow the wear that may occur to be taken-up.

Each tool mount further includes a spacer head washer 116. Two different thicknesses of the washer are provided for alternate tools to give the tools different offsets. In other words, one set of tools will be offset one distance towards the incoming log and the other set a second distance further towards the log. One set of the washers for approximately half the debarking tools is 3/32 of an inch thicker (or longer) than the others. This offsetting causes less shock loading to tools 22 and the debarker. With half (or one less than half where there is an odd number of tools) of the tools striking the leading of the log at one instant the shock loading is reduced generally by that same proportion. Also, because of the increase in spacing between the tools a small log can enter the machine without having to climb the log's leading edge. Setting every other tool out allows the log to get behind the tools so the debarking tools can mount to the debarking surface. For field conversions it is only necessary to add extension washers to half (alternating) of the tools.

The curvature of the tool 22 allows the sharp debarking tip surface to ride on the log surface throughout its debarking log range, as best shown in FIG. 4. In contrast, the known design of the tool's sharp debarking surface is caused to be lifted out of contact with the log debarking surface as the log diameter increases and on large logs the heel or flat section behind the tip is trying to remove the bark. This causes the operator to have to increase the debarking tensioning so that the bark can be removed. Another disadvantage overcome by the present design.

From the foregoing detailed description, it will be evident that there are a number of changes, adaptations, and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. A log debarker comprising:

a rotatable rotor through which logs can be fed, a tool shaft connected to said rotor, a tool shaft head connected to said tool shaft, said tool shaft head including a load-carrying slot portion, a rigid cutting tool having a key member adapted to be positioned in said load-carrying slot portion, said rigid cutting tool having a sharp elongated leading edge, and a holding means for holding said key member in said slot portion, and thus said cutting tool to said tools shaft head so that said cutting tool is sloped at an angle in the direction of travel of a log entering said rotor.

2. The log debarker of claim 1 including, said tool shaft having a longitudinal shaft axis, and said slot portion being disposed generally perpendicular to said shaft axis.

3. The log debarker of claim 1 including, said holding means retaining said key member in said slot portion so that said slot portion carries generally all of the forces of said cutting tool to said tool shaft.

4. The log debarker of claim 1 including, a tensioning means connected to said tool shaft.

5. The log debarker of claim 1 including, a spacer positioned between said rotor and said tool shaft head for positioning said cutting tool further from said rotor and closer to a log coming into the log debarker.

6. The log debarker of claim 1 including, said holding means comprising a plurality of bolts extending between said tool shaft head and said cutting tool.

7. The log debarker of claim 1 including, said tool shaft head having an outer cutting tool contact face, said slot portion being disposed on said contact face, and said holding means securing said cutting tool to said contact face.

8. The log debarker of claim 7 including, said contact face being disposed at an angle relative to and in the direction of log travel through the log debarker.

9. The log debarker of claim 8 including, said angle being between three and fifteen degrees, inclusive.

10. The log debarker of claim 9 including, said angle being generally five degrees.

11. The log debarker of claim 7 including, said cutting tool having an outer tip, and said contact face positioning said cutting tool so that an incoming log impacts said tool at a central point on said tool spaced inward from said tip.

12. The log debarker of claim 1 including,
said tool shaft being pivotally mounted about a longitudinal pivot axis,
a tensioning means for placing said tool shaft in tension about said pivot axis, and
said tool having its outermost tip continually pointing towards the centerline of an incoming log as said tool shaft pivots about said pivot axis.
13. The log debarker of claim 1 including,
said key member comprising a load-carrying retainer plate.
14. The log debarker of claim 1 including,
said tool including a replaceable tool tip.
15. The log debarker of claim 1 including,
said tool being mounted on the infeed side of the log debarker.
16. The log debarker of claim 1 including,
said tool shaft having its longitudinal axis disposed parallel to the direction of log travel.
17. A log debarker comprising:
a stator,
a rotor rotatably journaled in said stator and having an infeed side,
a first rigid log debarking tool having a sharp leading tool edge and attached to said infeed side of said rotor,
a second rigid log debarking tool having a sharp leading tool edge and attached to said infeed side of said rotor, and
a tool mounting means for mounting said first and second debarking tools to said infeed side of said rotor such that said first debarking tool extends forward of the plane of the forwardmost point of said second debarking tool and thereby contacts an incoming log before said second debarking tool and such that said first and second debarking tools are sloped at an angle in the direction of travel of a log entering said rotor.
18. The log debarker of claim 17 including,
said tool mounting means mounting said first and second tools generally adjacent to one another on said rotor.
19. The log debarker of claim 17 including,
third and fourth debarking tools attached to said rotor, and
said tool mounting means mounting said third tool so that its forwardmost point is in the plane generally coincident with that of said first tool and mounting said fourth tool so that its forwardmost point is in the plane generally coincident with that of said second tool.
20. The log debarker of claim 19 including,
said tool mounting means including an extension spacer positioned between said rotor and said third rigid log debarking tool.
21. The log debarker of claim 17 including,
said tool mounting means including a first spacer associated with said first tool and a second spacer associated with said second tool.
22. The log debarker of claim 21 including,
said first and second spacers being positioned between said rotor and said first and second tools, respectively.
23. The log debarker of claim 22 including,
said first spacer extending said first tool 3/32 inches further from said rotor than said second spacer extends said second tool.
24. A log debarker comprising:
a rotatable rotor through which logs can be fed,
a tool shaft connected to said rotor,
a tool shaft head connected to said tool shaft,
a rigid cutting tool having a sharp leading edge, and
a securing means for securing said cutting tool on the infeed side of said rotor to said tool shaft head so that said cutting tool is sloped at an angle in the direction of travel of a log entering said rotor.
25. The assembly of claim 24 including,
said angle being between three and fifteen degrees, inclusive.
26. The assembly of claim 25 including,
said angle being five degrees.
27. The assembly of claim 24 including,
said tool shaft head having a tool contact face against which said securing means secures said cutting tool, and
said contact face defining a face angle relative to the axis of an incoming log.
28. The assembly of claim 27 including,
said face angle being the same magnitude as said angle.
29. A log debarker comprising:
a rotatable rotor through which logs can be fed,
a tool shaft connected to said rotor,
a rigid cutting tool,
said rigid cutting tool having a sharp elongated leading edge, and
a securing means for securing said cutting tool on the infeed side of said rotor to said tool shaft so that said sharp leading edge is sloped at an angle in the direction of travel of a log entering said rotor.
30. The assembly of claim 29 including,
said angle being between three and fifteen degrees, inclusive.
31. The assembly of claim 29 including,
said angle being five degrees.
32. The assembly of claim 29 including,
a tool shaft head connected to said tool shaft, and
said securing means securing said cutting tool to said tool shaft head.
33. The assembly of claim 32 including,
said tool shaft head having a tool contact face against which said securing means secures said cutting tool, and
said contact face defining a face angle relative to the axis of an incoming log.
34. The assembly of claim 33 including,
said face angle being the same magnitude as said angle.
35. The assembly of claim 33 including,
said tool shaft head including a load carrying slot portion on said tool contact face,
said cutting tool having a key member adapted to be positioned in said load carrying slot portion, and
said securing means securing said key member in said slot portion.

* * * * *